US009895277B2

(12) United States Patent
Yamada et al.

(10) Patent No.: US 9,895,277 B2
(45) Date of Patent: Feb. 20, 2018

(54) TRANSFER ASSISTANCE DEVICE

(71) Applicant: TOYOTA JIDOSHA KABUSHIKI KAISHA, Toyota-shi (JP)

(72) Inventors: Yuji Yamada, Toyota (JP); Yuhei Yamaguchi, Toyota (JP); Yuichi Matsumae, Kiyosu (JP); Yoshimi Kajitani, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/284,233

(22) Filed: Oct. 3, 2016

(65) Prior Publication Data

US 2017/0100293 A1 Apr. 13, 2017

(30) Foreign Application Priority Data

Oct. 8, 2015 (JP) ..... 2015-200578

(51) Int. Cl.
*A61G 7/10* (2006.01)
*A61G 7/14* (2006.01)
(Continued)

(52) U.S. Cl.
CPC ..... *A61G 7/1049* (2013.01); *A61G 5/14* (2013.01); *A61G 7/1001* (2013.01); *A61G 7/1017* (2013.01); *A61G 7/1034* (2013.01); *A61G 7/1036* (2013.01); *A61G 7/1048* (2013.01); *A61G 7/1086* (2013.01); *A61G 7/1098* (2013.01); *A61H 3/04* (2013.01);
(Continued)

(58) Field of Classification Search
CPC .. A61G 7/1013; A61G 7/1017; A61G 7/1019; A61G 7/1021; A61G 7/1046; A61G 7/1048; A61G 7/1049; A61G 7/1051; A61G 7/1061; A61G 7/002; A61G 7/005; A61G 7/008; A61G 7/012; A61G 7/015; A61G 7/018; A61G 13/02; A61G 13/04; A61G 13/06; A61G 13/08
USPC ..... 5/86.1, 81.1 R, 83.1, 87.1, 600, 607–611
See application file for complete search history.

(56) References Cited

U.S. PATENT DOCUMENTS 6,282,736 B1 * 9/2001 Hand ..... A61B 6/0428 5/600
6,499,160 B2 * 12/2002 Hand ..... A61B 6/0428 5/600
(Continued)

FOREIGN PATENT DOCUMENTS

JP 09-570 A 1/1997
JP 2000-024040 A 1/2000
(Continued)

*Primary Examiner* — Robert G Santos
(74) *Attorney, Agent, or Firm* — Oblon, McClelland, Maier & Neustadt, L.L.P.

(57) ABSTRACT

The transfer assistance device includes a bogie, an arm tiltably supported by the bogie, a holding part that is supported by the arm and holds a torso of a person being assisted. The holding part includes at least a low pressure cell group and a high pressure cell group configured to respectively face different parts of a front surface of the torso of the person being assisted. The transfer assistance device further includes air pressure adjuster configured to individually adjust air pressure of the low pressure cell group and air pressure of the high pressure cell group.

7 Claims, 9 Drawing Sheets

(51) Int. Cl.
*A61G 5/14* (2006.01)
*A61H 3/04* (2006.01)
*A61G 7/057* (2006.01)

(52) U.S. Cl.
CPC ..... *A61G 7/05769* (2013.01); *A61G 2200/52* (2013.01); *A61H 2003/043* (2013.01); *A61H 2201/0103* (2013.01); *A61H 2201/0119* (2013.01); *A61H 2201/1207* (2013.01); *A61H 2201/1246* (2013.01); *A61H 2201/14* (2013.01); *A61H 2201/1409* (2013.01); *A61H 2201/164* (2013.01); *A61H 2201/1621* (2013.01); *A61H 2201/1676* (2013.01); *A61H 2201/5002* (2013.01); *A61H 2201/5007* (2013.01); *A61H 2201/5038* (2013.01); *A61H 2201/5071* (2013.01)

(56) References Cited

U.S. PATENT DOCUMENTS 6,526,610 B1 * 3/2003 Hand ..... A61F 7/007 5/503.1
6,691,347 B2 * 2/2004 Hand ..... A61B 6/0428 5/600
6,701,553 B1 * 3/2004 Hand ..... A61G 7/0522 5/428
6,862,759 B2 * 3/2005 Hand ..... A61F 7/007 5/428
7,137,160 B2 * 11/2006 Hand ..... A61G 7/0522 5/425
8,650,677 B2 * 2/2014 Altena ..... A61G 5/14 5/81.1 R
9,038,212 B2 * 5/2015 Yamaguchi ..... A61G 7/1017 5/87.1
2002/0026671 A1 * 3/2002 Hand ..... A61B 6/0428 5/608
2003/0115673 A1 * 6/2003 Hand ..... A61B 6/0428 5/608
2003/0126683 A1 * 7/2003 Hand ..... A61F 7/007 5/607
2004/0168253 A1 * 9/2004 Hand ..... A61G 7/0522 5/607
2011/0056019 A1 * 3/2011 Altena ..... A61G 5/14 5/87.1
2013/0263374 A1 * 10/2013 Yamaguchi ..... A61G 7/1017 5/87.1
2017/0100293 A1 * 4/2017 Yamada ..... A61G 7/1086

FOREIGN PATENT DOCUMENTS

JP 2001-513365 A 9/2001
JP 2005-192779 A 7/2005
JP 2010-131063 A 6/2010
JP 2011-115323 A 6/2011
JP 2014-061448 A 4/2014
JP 5562403 B2 7/2014
WO 96/11658 4/1996
WO WO 2012/101574 A2 8/2012

* cited by examiner

TRANSFER ASSISTANCE DEVICE

CROSS REFERENCE TO RELATED APPLICATION

This application is based upon and claims the benefit of priority from Japanese patent application No. 2015-200578, filed on Oct. 8, 2015, the disclosure of which is incorporated herein in its entirety by reference.

BACKGROUND

1. Field

The present disclosure relates to a transfer assistance device.

2. Description of Related Art

Japanese Unexamined Patent Application Publication No. 2014-61448 discloses a walking assistance device that that assists a person requiring assistance to walk. The walking assistance device includes a lower extremity frame, an upper extremity frame that is rotatably supported by the lower extremity frame, and a holding part that is supported by the upper extremity frame. The holding part includes a central part on which a central air bag is disposed, a left wing part on which a left air bag is disposed, and a right wing part on which a right air bag is disposed. The central part, the left wing part, and the right wing part are connected to form a C shape as a whole. The central part is disposed to face a front surface of a torso of the person requiring assistance. Likewise, the right wing part is disposed to face a right flank of the torso of the person requiring assistance, and the left wing part is disposed to face a left flank of the torso of the person requiring assistance.

The walking assistance device further includes a central air compressor that adjusts air pressure of the central air bag, a left air compressor that adjusts air pressure of the left air bag, and a right air compressor that adjusts air pressure of the right air bag. Thus, the air pressure of the central air bag, the air pressure of the left air bag, and the air pressure of the right air bag can be independently adjusted, and the air pressure can be differentiated among the central air bag, the left air bag, and the right air bag.

However, with the configuration disclosed in Japanese Unexamined Patent Application Publication No. 2014-61448, although the air pressure of the whole central air bag can be adjusted, the air pressure of different regions in the central air bag cannot be independently adjusted. This is also applicable to the lateral (right and left) air bags. There is thus a need for an improved technique that can reduce a burden on the person requiring assistance.

An object of the present disclosure is to provide a technique that adjusts pressure on different parts of one surface (a front surface, lateral surfaces, and a back surface) of a torso of a person being assisted so that the pressure on the above different parts of the one surface relatively differs so as to reduce a burden on the person being assisted at the time of assisting transfer of the person being assisted.

SUMMARY

An exemplary aspect of the present disclosure is a transfer assistance device that includes: a bogie; an arm tiltably supported by the bogie; a holding part that is supported by the arm and includes at least one of a front surface holding part configured to hold a front surface of a torso of a person being assisted, a lateral surface holding part configured to hold a lateral surface of a torso of a person being assisted, and a back surface holding part configured to hold a back surface of the torso of the person being assisted. The holding part includes at least a first bag and a second bag configured to respectively face different parts of at least one of the front surface, the lateral surface, and the back surface of the torso of the person being assisted. The transfer assistance device further includes an air pressure adjuster to individually adjust air pressure of the first bag and air pressure of the second bag. With such a configuration, when the transfer assistance device assists transfer of the person being assisted, it is possible to adjust pressure on different parts of at least one of the front surface, the lateral surface, and the back surface of the torso of the person being assisted so that the pressure will relatively differ on the different pans of the one of the front surface, the lateral surface, and the back surface of the torso of the person being assisted to thereby reduce a burden on the person being assisted.

The first bag is configured to face a solar plexus of the front surface of the torso of the person being assisted, the second bag is configured to face some or all parts other than the solar plexus of the front surface of the torso of the person being assisted, and the air pressure adjuster is configured to adjust the air pressure of the first bag to be lower than the air pressure of the second bag when the holding part holds the person being assisted. With such a configuration, it is possible to effectively reduce a burden on the solar plexus of the torso of the person being assisted when the transfer assistance device assists transfer of the person being assisted.

According to the present disclosure, it is possible to reduce a burden on a person being assisted.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF THE EXEMPLARY EMBODIMENTS

Figure 1:
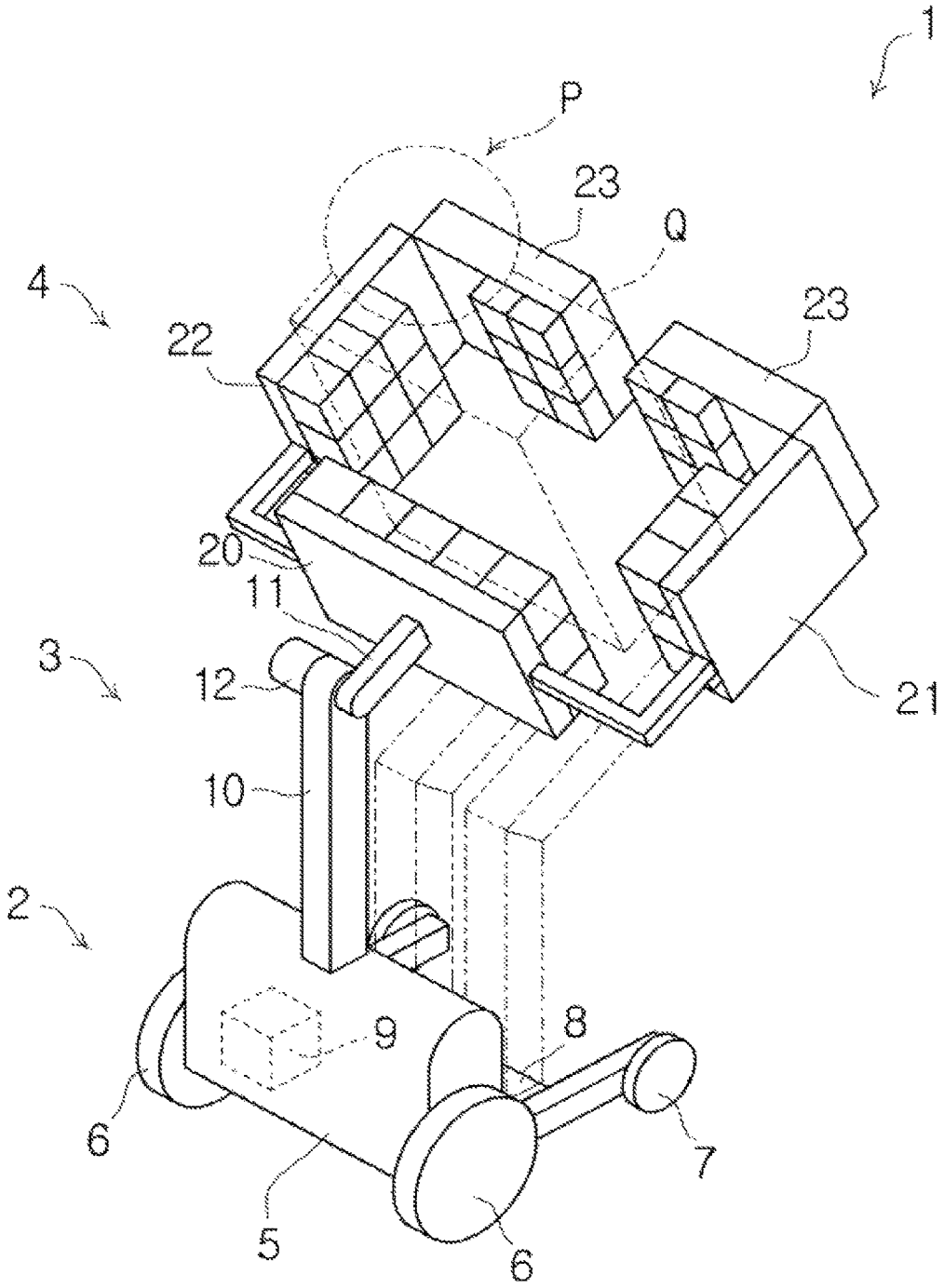
FIG. 1 is a perspective diagram of a transfer assistance device.

FIG. 1 is a perspective diagram of a transfer assistance device 1. The transfer assistance device 1 is a device for transferring a person being assisted P who is sitting on a bed or the like to a wheel chair or the like. The transfer assistance device 1 includes a bogie 2, an arm 3, and a holding part 4.

The bogie 2 includes a bogie body 5, two driving wheels 6, two trailing wheels 7, a footrest plate 8, and a bogie motor 9. The two driving wheels 6 are rotationally driven by the bogie motor 9. The footrest plate 8 is a plate on which soles of feet of the person being assisted P are placed.

The arm 3 is tiltably supported by the bogie 2. The arm 3 includes a lower arm 10 that is fixed to the bogie body 5 and is vertically extended, an upper arm 11 that is tiltably supported by an upper end of the lower arm 10, and an arm motor 12 that tilts and drives the upper arm 11.

The holding part 4 is supported by the arm 3 and holds a torso Q of the person being assisted P. The holding part 4 includes a front surface holding part 20, a left flank holding part 21 (a lateral surface holding part), a right flank holding part 22 (a lateral surface holding part), and two back surface holding parts 23.

Figure 2:
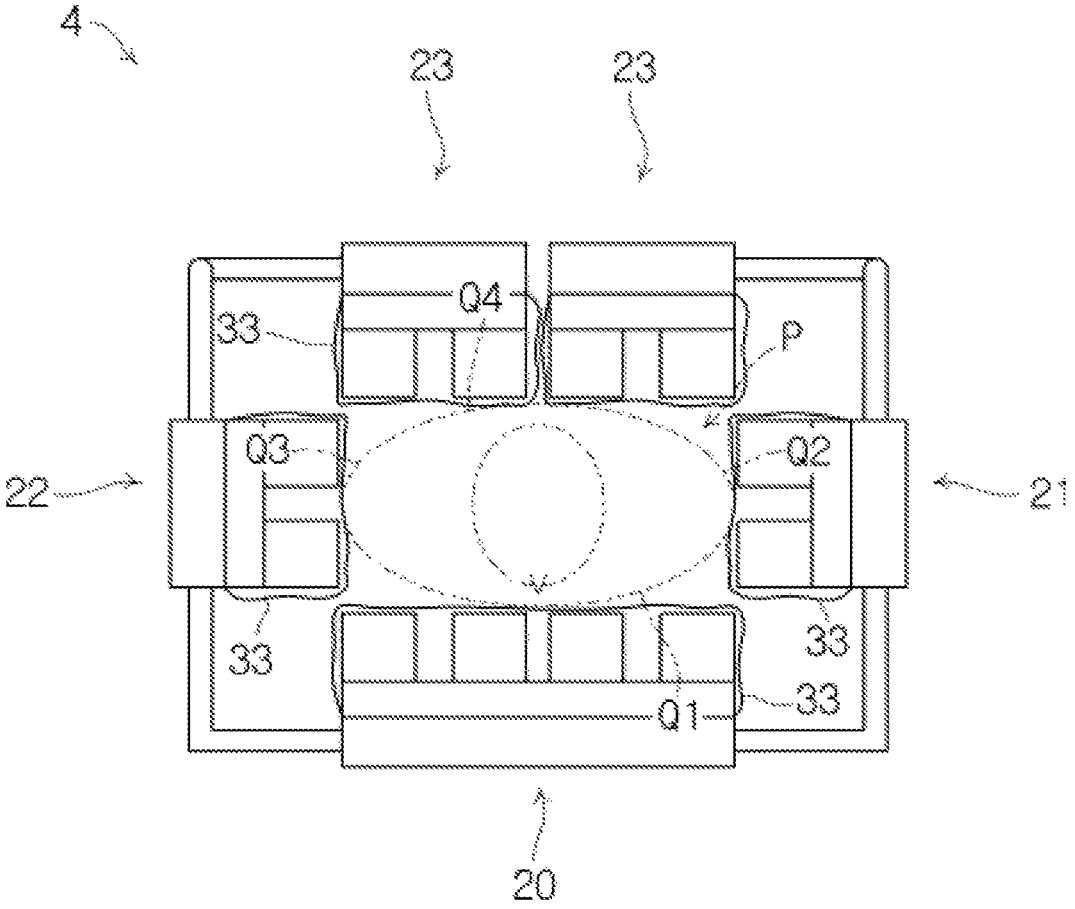
FIG. 2 is a plan view of a holding part.

FIG. 2 is a plan view of the holding part 4. The front surface holding part 20 faces a front surface Q1 of the torso Q of the person being assisted P and is attached to a leading end of the upper arm 11 of the arm 3. The left flank holding part 21 faces a left flank Q2 (a lateral surface) of the torso Q of the person being assisted P. The right flank holding part 22 faces a right flank Q3 (a lateral surface) of the torso Q of the person being assisted P. The left flank holding part 21 and the right flank holding part 22 are supported by the front surface holding part 20. A distance between the left flank holding part 21 and the right flank holding part 22 is configured to be adjustable as appropriate according to a build of the person being assisted P. The two back surface holding parts 23 face a back surface Q4 of the torso Q of the person being assisted P. One of the two back surface holding parts 23 is supported by the left flank holding part 21 in such a way that the one of the two back surface holding parts 23 can be freely opened and closed, and the other one of the two back surface holding parts 23 is supported by the right flank holding part 22 in such a way that the other one of the two back surface holding parts 23 can be freely opened and closed.

Figure 3:
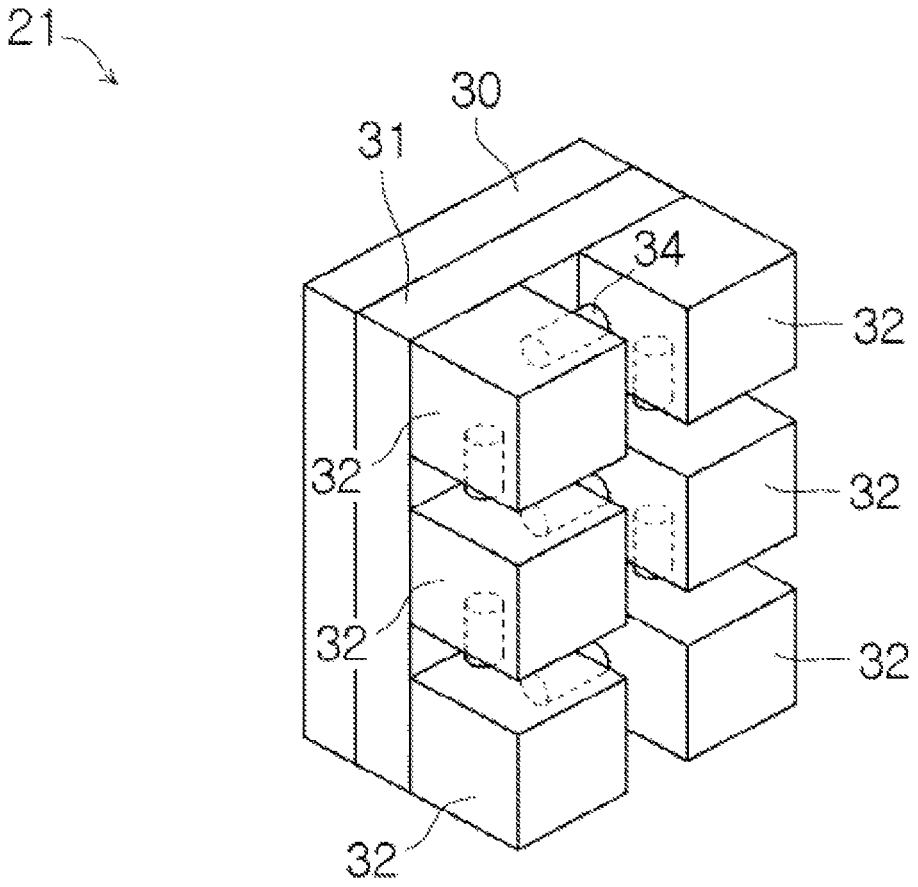
FIG. 3 is a perspective diagram of a left flank holding part.

FIG. 3 is a perspective diagram of the left flank holding part 21. As shown in FIG. 3, the left flank holding part 21 is configured to include a base plate 30, a cushion 31, a plurality of air cells 32, and an outer skin 33 (see FIG. 2). The base plate 30 is formed of resin, carbon fiber, a metal plate, or other hard materials. The cushion 31 is pasted onto the base plate 30 and is formed of urethane foam or other soft materials. The plurality of air cells 32 (small bags) are pasted onto the cushion 31 and are boxes formed of sheet-like polyurethane, polyvinyl chloride, or rubber material. Each of the air cells 32 inflates or deflates according to an amount of air pressure inside. As shown in FIG. 2, the outer skin 33 is disposed to cover over the plurality of air cells 32. The outer skin 33 is formed of an elastic material so that the outer skin 33 will not inhibit the inflation and deflation of the air cells 32. As shown in FIG. 3, the plurality of air cells 32 are connected to each other by airflow path parts 34 to enable air to flow among the air cells 32.

As the right flank holding part 22 and the two back surface holding parts 23 have the same configuration as that of the left flank holding part 21, descriptions thereof will be omitted.

Figure 4:
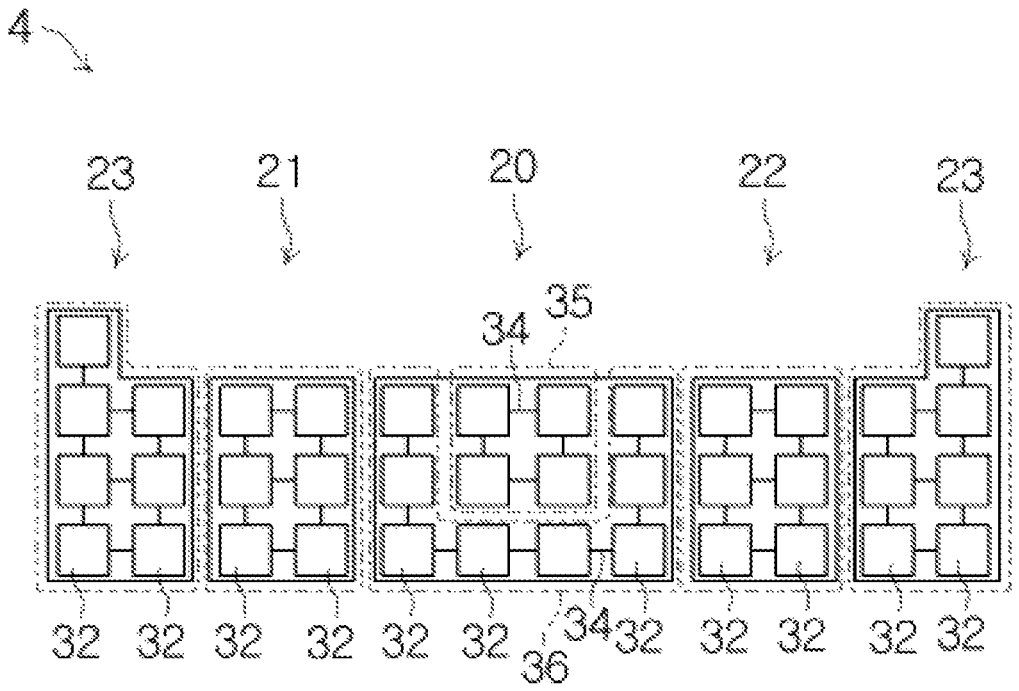
FIG. 4 is a developed view of the holding part.

FIG. 4 is a developed view of the holding part 4. As shown in FIG. 4, as with the left flank holding part 21, the front surface holding part 20 also includes the base plate 30, the cushion 31, the plurality of air cells 32, and the outer skin 33 (see FIG. 2). However, in the front surface holding part 20, the plurality of air cells 32 are divided into a low pressure cell group 35 and a high pressure cell group 36. The plurality of air cells 32 belonging to the low pressure cell group 35 face a solar plexus of the torso Q of the person being assisted P when the holding part 4 holds the torso Q of the person being assisted P. On the other hand, the plurality of air cells 32 belonging to the high pressure cell group 36 face parts other than the solar plexus of the torso Q of the person being assisted P when the holding part 4 holds the torso Q of the person being assisted P. The plurality of air cells 32 belonging to the low pressure cell group 35 are connected to one another by the airflow path parts 34 so that air can flow through the plurality of air cells 32 belonging to the low pressure cell group 35. Likewise, the plurality of air cells 32 belonging to the high pressure cell group 36 are connected to one another by the airflow path parts 34 so that air can flow through the plurality of air cells 32 belonging to the high pressure cell group 36. On the other hand, as the plurality of air cells 32 belonging to the low pressure cell group 35 and the plurality of air cells 32 belonging to the high pressure cell group 36 are not connected, air cannot flow between the plurality of air cells 32 belonging to the low pressure cell group 35 and the plurality of air cells 32 belonging to the high pressure cell group 36. With such a configuration, the air pressure of the respective air cells 32 belonging to the low pressure cell group 35 and the air pressure of the respective air cells 32 belonging to the high pressure cell group 36 can be differentiated.

Figure 5:
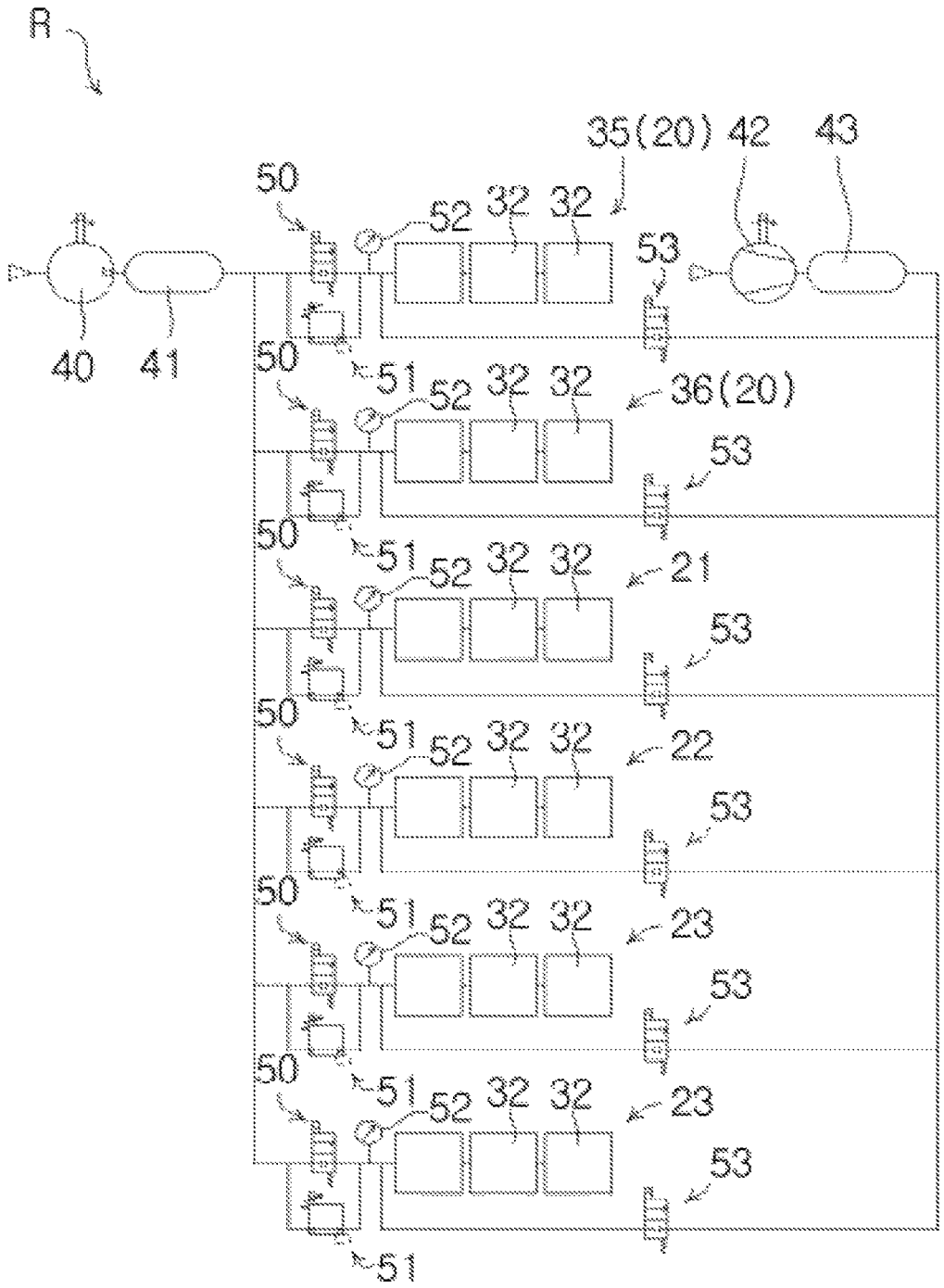
FIG. 5 is a block diagram of an air pressure adjusting mechanism.

Next, an air pressure adjusting mechanism R that adjusts the air pressure of the respective air cells 32 belonging to the front surface holding part 20, the left flank holding part 21, the right flank holding part 22, and two back surface holding parts 23 will be described with reference to FIG. 5.

The air pressure adjusting mechanism R includes a compressor 40, a positive pressure tank 41, a vacuum pump 42, and a negative pressure tank 43. The compressor 40 adjusts air pressure inside the positive pressure tank 41 to a predetermined air pressure that is higher than atmospheric pressure, which is positive pressure. The vacuum pump 42 adjusts air pressure inside the negative pressure tank 43 to a predetermined air pressure that is lower than the atmospheric pressure, which is negative pressure. The air pressure adjusting mechanism R includes six positive pressure side solenoid valves 50, six electro-pneumatic regulators 51, six pressure gauges 52, and six negative pressure side solenoid valves 53.

(Low Pressure Cell Group 35)

Any one of the air cells 32 belonging to the low pressure cell group 35 is connected to the positive pressure tank 41 with one of the positive pressure side solenoid valves 50 and one of the electro-pneumatic regulators 51 interposed therebetween. The positive pressure side solenoid valve 50 and the electro-pneumatic regulator 51 are disposed in parallel between the above air cells 32 belonging to the low pressure cell group 35 and the positive pressure tank 41. The positive pressure side solenoid valves 50 control the valves to be fully opened or closed according to input signals. The electro-pneumatic regulators 51 adjust air pressure to be output by feedback control according to the input signals. Thus, although the electro-pneumatic regulators 51 can adjust the air pressure in the respective air cells 32 belonging to the low pressure cell group 35 highly accurately, responsiveness of the electro-pneumatic regulators 51 is poor. The air cells 32 belonging to the low pressure cell group 35 are connected to the negative pressure tank 43 with one of the negative pressure side solenoid valves 53 interposed therebetween. One of the pressure gauges 52 measures the air pressure of the respective air cells 32 belonging to the low pressure cell group 35.

(High Pressure Cell Group 36)

Likewise, any one of the air cells 32 belonging to the high pressure cell group 36 is connected to the positive pressure tank 41 with one of the positive pressure side solenoid valves 50 and one of the electro-pneumatic regulators 51 interposed therebetween. The positive pressure side solenoid valve 50 and the electro-pneumatic regulator 51 are disposed in parallel between the above air cells 32 belonging to the high pressure cell group 36 and the positive pressure tank 41. The air cells 32 belonging to the high pressure cell group 36 are connected to the negative pressure tank 43 with one of the negative pressure side solenoid valves 53 interposed therebetween. One of the pressure gauges 52 measures the air pressure of the respective air cells 32 belonging to the high pressure cell group 36.

(Left Flank Holding Part 21, Etc.)

As the structure that adjusts the air pressure of the plurality of air cells 32 of the left flank holding part 21, the right flank holding part 22, and two back surface holding parts 23 is the same as the one described above, a description thereof will be omitted.

With the above configuration, the air pressure adjusting mechanism R can individually adjust: the air pressure that is common to the plurality of air cells 32 belonging to the low pressure cell group 35, the air pressure that is common to the plurality of air cells 32 belonging to the high pressure cell group 36, the air pressure that is common to the plurality of air cells 32 of the left flank holding part 21, the air pressure that is common to the plurality of air cells 32 of the right flank holding part 22, the air pressure that is common to the plurality of air cells 32 of one of the back surface holding parts 23, and the air pressure that is common to the plurality of air cells 32 of the other one of the back surface holding parts 23.

Figure 6:
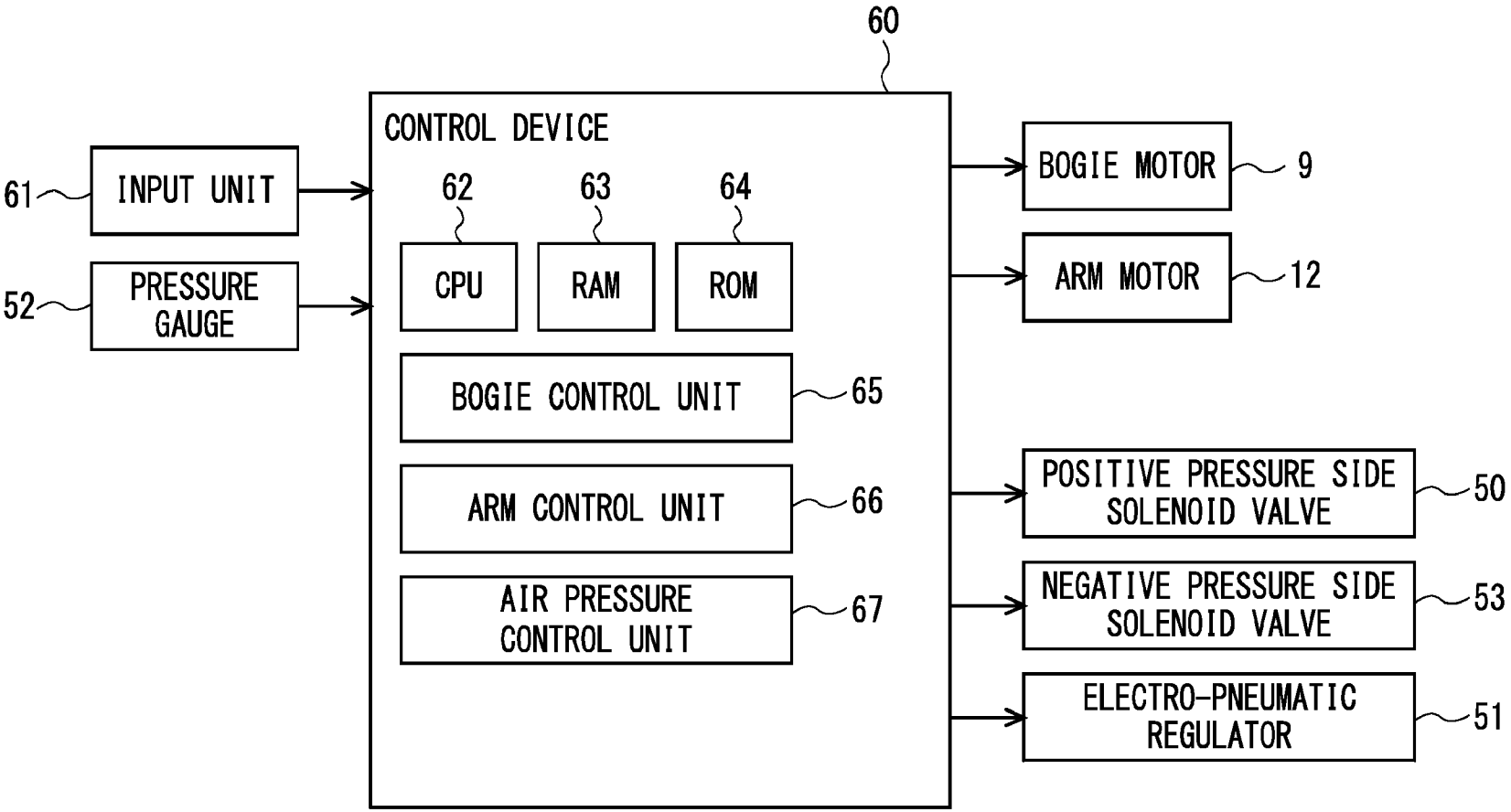
FIG. 6 is a functional block diagram of a transfer assistance device.
Figure 7:
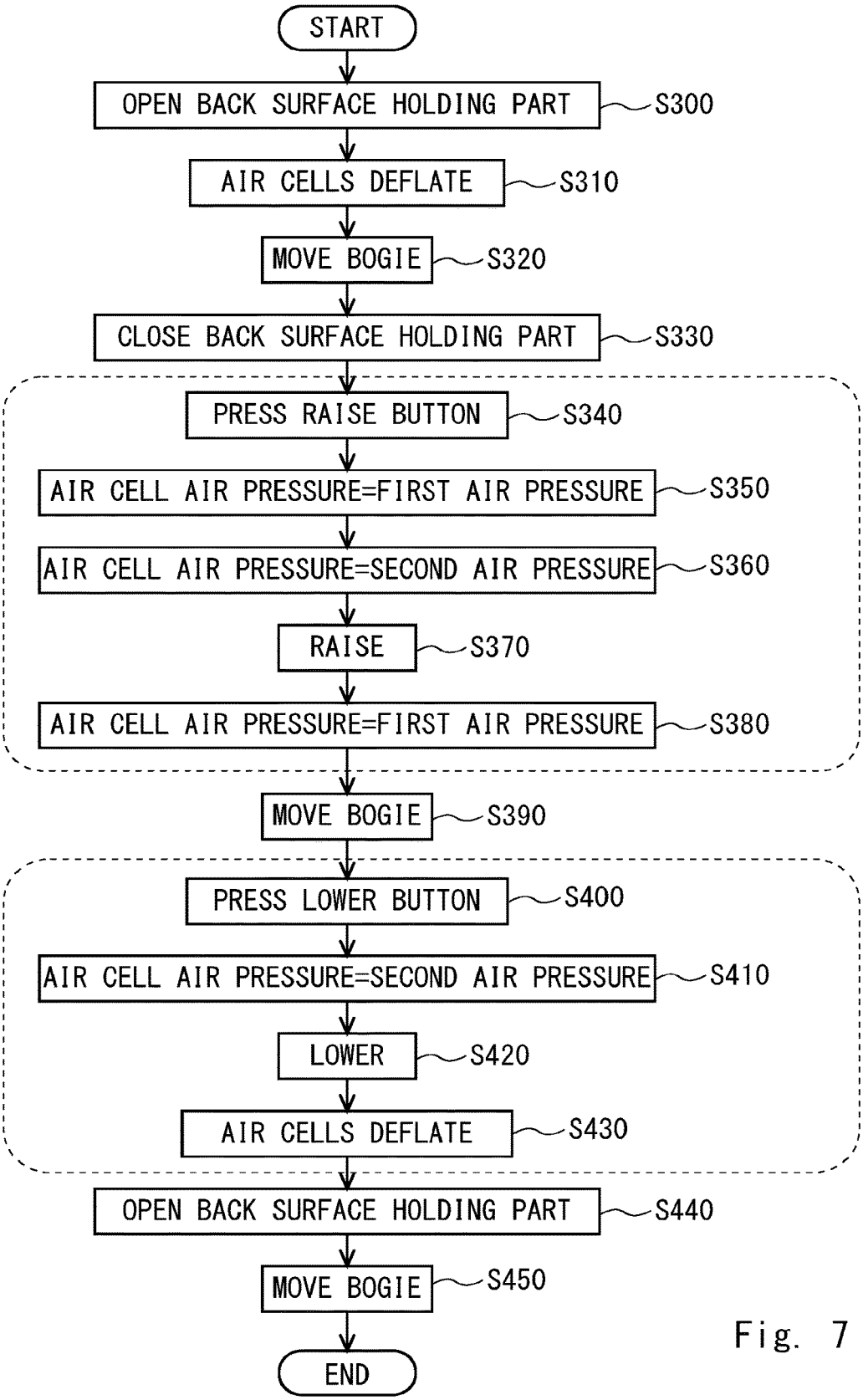
FIG. 7 is a flowchart for explaining transfer of a person being assisted.

FIG. 6 is a functional block diagram of the transfer assistance device 1. As shown in FIG. 6, the transfer assistance device 1 further includes a control unit 60 and an input unit 61. The input unit 61 is for an assisting person to operate the transfer assistance device 1. The control unit 60 includes a CPU 62 (Central Processing Unit) that is a central processing unit, a RAM 63 (Random Access Memory) that is readable and writable, and a ROM 64 (Read Only Memory) that is read only. When the CPU 62 reads a control program stored in the ROM 64 and executes the control program, the control program enables hardware such as the CPU 62 to function as a bogie control unit 65, an arm control unit 66, and an air pressure control unit 67.

The bogie control unit 65 drives the bogie motor 9 according to a signal from the input unit 61 in order to control the bogie 2.

The arm control unit 66 drives the arm motor 12 according to a signal from the input unit 61 in order to control tilting of the arm 3.

The air pressure control unit 67 controls the six positive pressure side solenoid valves 50, the six electro-pneumatic regulators 51, and the six negative pressure side solenoid valves 53 according to signals from the input unit 61 and signals from the six pressure gauges 52. When the air pressure control unit 67 outputs HIGH to the positive pressure side solenoid valves 50, the positive pressure side solenoid valves 50 are opened, while when the air pressure control unit 67 outputs LOW to the positive pressure side solenoid valves 50, the positive pressure side solenoid valves 50 are closed. The electro-pneumatic regulators 51 perform feedback control on the air pressure to be output according to a voltage value output from the air pressure control unit 67 to the electro-pneumatic regulators 51. When the air pressure control unit 67 outputs HIGH to the negative pressure side solenoid valves 53, the negative pressure side solenoid valves 53 are opened, while when the air pressure control unit 67 outputs LOW to the negative pressure side solenoid valves 53, the negative pressure side solenoid valves 53 are closed.

Next, transfer of the person being assisted P using the transfer assistance device 1 will be described with reference to FIGS. 7 to 10.

Figure 8:
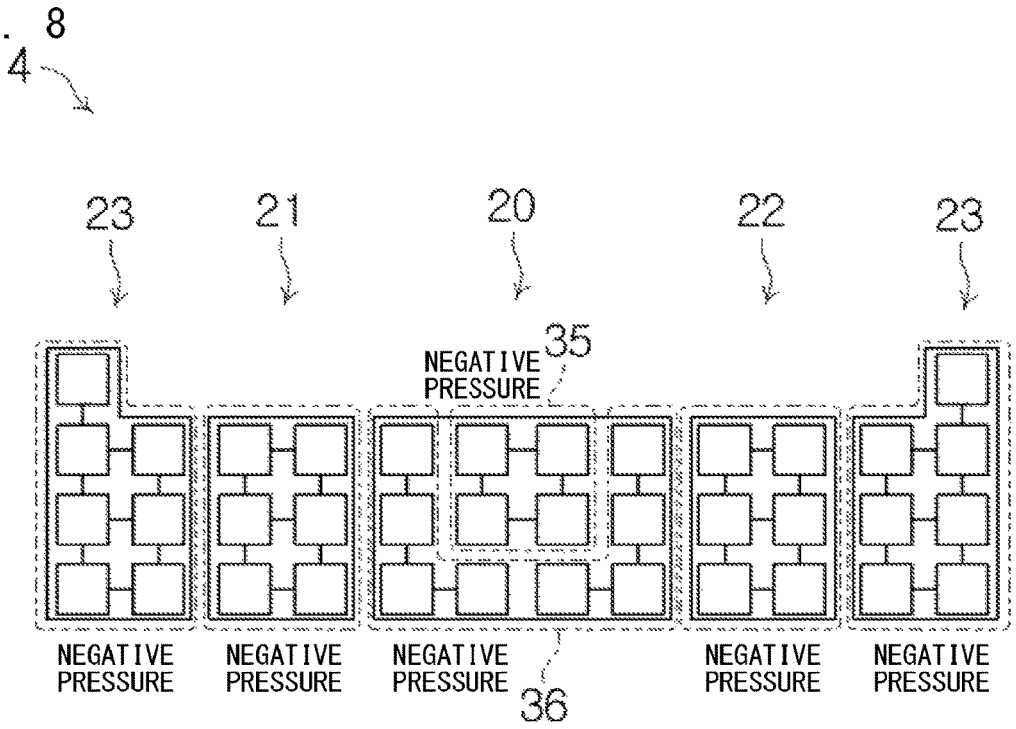
FIG. 8 is a drawing showing a pressure distribution of air pressure of the holding part.

Firstly, the assisting person opens the two back surface holding parts 23 outward (S300). Next, the assisting person operates the input unit 61, as shown in FIG. 8, to supply negative pressure to all the air cells 32 so that the air cells 32 will deflate (S310). Next, the assisting person operates the input unit 61 to run the transfer assistance device 1 and move the transfer assistance device 1 in front of the person being assisted P (S320). Next, the assisting person closes the two back surface holding parts 23 inward (S330). At this time, the assisting person places the soles of the feet of the person being assisted P on the footrest plate 8.

Figure 9:
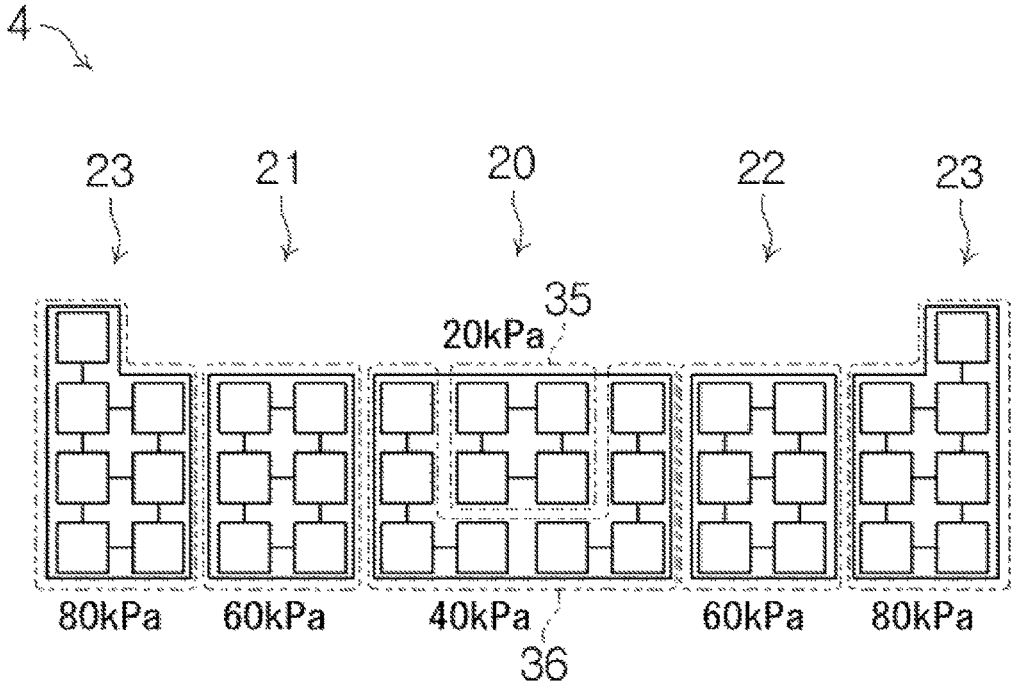
FIG. 9 is a drawing showing a pressure distribution of the air pressure of the holding part.

Next, the assisting person presses a raise button (not shown) of the input unit 61 (S340). Then, as shown in FIG. 9, firstly the air pressure control unit 67 supplies positive pressure to the respective air cells 32 so that the air pressure of the respective air cells 32 will be a first air pressure (S350). The first air pressure is, as shown in FIG. 9, 20 kPa for the air pressure of the low pressure cell group 35, 40 kPa for the air pressure of the high pressure cell group 36, 60 kPa for the air pressure of the left flank holding part 21 and the right flank holding part 22, and 80 kPa for the air pressure of the two back surface holding parts 23. Thus, the holding part 4 temporarily holds the torso Q of the person being assisted P.

Figure 10:
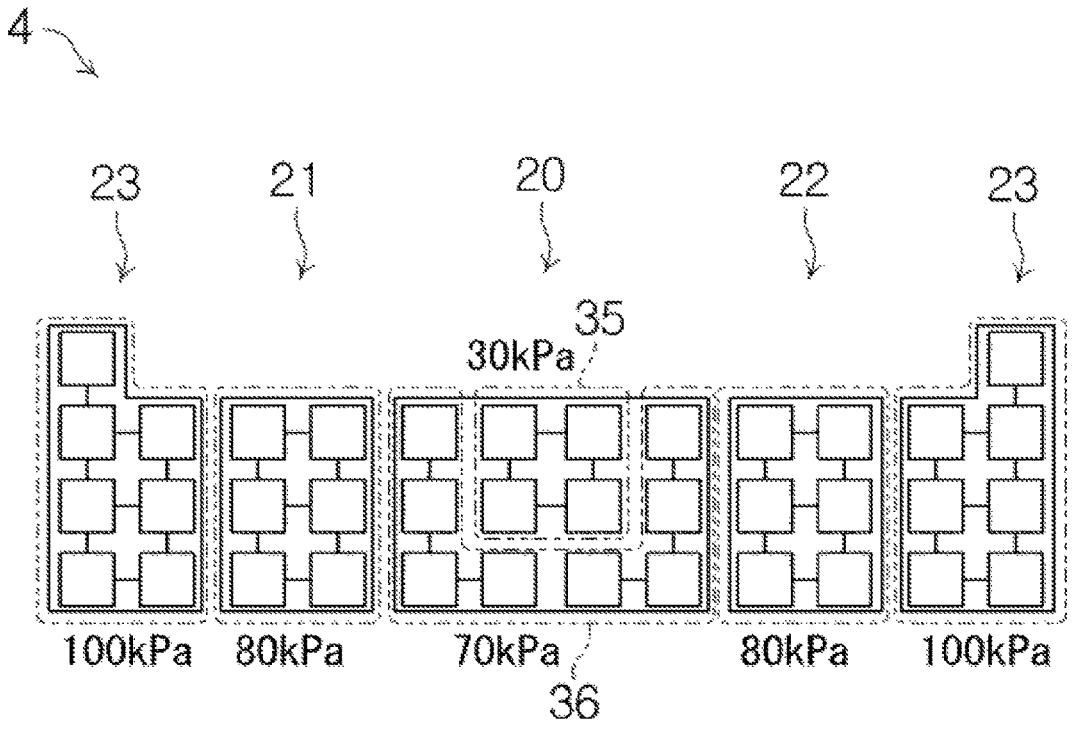
FIG. 10 is a drawing showing a pressure distribution of the air pressure of the holding part.

Next, as shown in FIG. 10, the air pressure control unit 67 supplies positive pressure to the respective air cells 32 so that the air pressure of the respective air cells 32 will be a 1 second air pressure (S360). The second air pressure is, as shown in FIG. 10, 30 kPa for the air pressure of the low pressure cell group 35, 70 kPa for the air pressure of the high pressure cell group 36, 80 kPa for the air pressure of the left flank holding part 21 and the right flank holding part 22, and 100 kPa for the air pressure of the two back surface holding parts 23. Thus, the holding part 4 firmly holds the torso Q of the person being assisted P.

Next, the arm control unit 66 controls tilting of the arm 3 to thereby raise the person being assisted P while holding the person being assisted (S370). Then, the air pressure control unit 67 returns the air pressure of the respective air cells 32 to the first air pressure (S380).

Next, the assisting person operates the input unit 61 to move the transfer assistance device 1 that is holding the person being assisted P to a desired location (S390).

Next, the assisting person presses a lower button (not shown) of the input unit 61 (S400). Then, firstly, the air pressure control unit 67 increases the air pressure of the respective air cells 32 to the second air pressure again (S410). Next, the arm control unit 66 controls the tilting of the arm 3 to lower the person being assisted P while holding the person being assisted P (S420) and seats the person being assisted P on a bed or the like. Next, the air pressure control unit 67 supplies negative pressure to the respective air cells 32 so that the respective air cells 32 will deflate (S430).

Next, the assisting person opens the two back surface holding parts 23 outward (S440), and operates the input unit 61 to move the transfer assistance device 1 away from the person being assisted P (S450). In this manner, transfer of the person being assisted P is completed.

In this exemplary embodiment, air pressure adjuster corresponds to the air pressure adjusting mechanism R and the air pressure control unit 67.

The preferable exemplary embodiment has been explained so far. The above exemplary embodiment has the following features.

The transfer assistance device 1 includes the bogie 2, the arm 3 that is tiltably supported by the bogie 2, and the holding part 4 that is supported by the arm 3 and holds the torso Q of the person being assisted P. The holding part 4 includes at least the low pressure cell group 35 (a first bag) and the high pressure cell group 36 (a second bag) that are disposed to face different parts of the front surface Q1 of the torso Q of the person being assisted P. The transfer assistance device 1 further includes the air pressure adjuster (the air pressure adjusting mechanism R and the air pressure control unit 67) that can individually adjust the air pressure of the low pressure cell group 35 and the air pressure of the high pressure cell group 36. With such a configuration, when the transfer assistance device 1 assists transfer of the person being assisted P, it is possible to adjust pressure on different parts of the front surface of the torso of the person being assisted so that the pressure will relatively differ on the different parts to of the front surface of the torso of the person being assisted thereby reduce a burden on the person being assisted P.

The low pressure cell group 35 is disposed to face the solar plexus of the front surface Q1 of the torso Q of the person being assisted P. The high pressure cell group 36 is disposed to face some or all of the parts other than the solar plexus of the front surface Q1 of the torso Q of the person being assisted P. The air pressure adjuster adjusts the air pressure of the low pressure cell group 35 to be lower than that of the high pressure cell group 36 when the holding part 4 holds the person being assisted P. With such a configuration, it is possible to effectively reduce a burden on the solar plexus of the torso Q of the person being assisted P when the transfer assistance device 1 assists transfer of the person being assisted P.

The low pressure cell group 35 and the high pressure cell group 36 include the plurality of air cells 32 (small bags) that project toward the torso Q of the person being assisted P and the airflow path parts 34 that are connected between the plurality of air cells 32 to enable air to flow among the plurality of air cells 32. With such a configuration, when the plurality of air cells 32 are individually deformed, the low pressure cell group 35 or the high pressure cell group 36 can be in contact with the torso Q of the person being assisted P with uniform surface pressure.

The air pressure adjuster includes positive pressure supply means (the compressor 40 and the positive pressure tank 41) that supplies positive pressure to the low pressure cell group 35 and the high pressure cell group 36 and negative pressure supply means (the vacuum pump 42 and the negative pressure tank 43) that supplies negative pressure to the low pressure cell group 35 and the high pressure cell group 36. With such a configuration, it is possible to adjust the air pressure of the low pressure cell group 35 and the high pressure cell group 36 more quickly than when the air pressure adjuster does not include the negative pressure supply means (the vacuum pump 42 and the negative pressure tank 43).

The exemplary embodiment that has been explained above can be modified in the following manner.

For example, in the above exemplary embodiment, the holding part 4 includes at least the low pressure cell group 35 (the first bag) and the high pressure cell group 36 (the second bag) that are disposed to respectively face the different parts of the front surface Q1 of the torso Q of the person being assisted P. However, in place of the above configuration or in addition to the above configuration, the holding part 4 may include at least the low pressure cell group (the first bag) and the high pressure cell group (the second bag) that are disposed to respectively face different parts of the back surface Q4 of the torso Q of the person being assisted P. More specifically, for example, the low pressure cell group is disposed to face parts not protected by ribs of the back surface Q4 of the torso Q of the person being assisted P. The high pressure cell group is disposed to face some or all of parts protected by the ribs of the back surface Q4 of the torso Q of the person being assisted P. The air pressure adjuster adjusts the air pressure of the low pressure cell group 35 to be lower than that of the high pressure cell group when the holding part 4 holds the person being assisted P. With such a configuration, it is possible to effectively reduce a burden on the parts not protected by the ribs of the back surface Q4 of the torso Q of the person being assisted P when the transfer assistance device 1 assists transfer of the person being assisted P.

Likewise, the holding part 4 may include at least the low pressure cell group (the first bag) and the high pressure cell group (the second bag) that are disposed to respectively face different parts of the left flank Q2 (the lateral surface) of the torso Q of the person being assisted P. Likewise, the holding part 4 may include at least the low pressure cell group (the first bag) and the high pressure cell group (the second bag) that are disposed to respectively face different parts of the right flank Q3 (the lateral surface) of the torso Q of the person being assisted P. More specifically, for example, the low pressure cell group is disposed to face parts not protected by ribs of the lateral surfaces (the left flank Q2 and the right flank Q3) of the torso Q of the person being assisted P. The high pressure cell group is disposed to face some or all parts protected by the ribs of the lateral surfaces (the left flank Q2 and the right flank Q3) of the torso Q of the person being assisted P. The air pressure adjuster adjusts the air pressure of the low pressure cell group 35 to be lower than that of the high pressure cell group when the holding part 4 holds the person being assisted P. With such a configuration, it is possible to effectively reduce a burden on the parts not protected by the ribs of the lateral surfaces (the left flank Q2 and the right flank Q3) of the torso Q of the person being assisted P when the transfer assistance device 1 assists transfer of the person being assisted P.

According to the above modified example, when the transfer assistance device 1 assists transfer of the person being assisted P, it is possible to adjust pressure on different parts of any one of the front surface, the lateral surfaces (the right flank and the left flank), and the back surface of the torso of the person being assisted so that the pressure will relatively differ on the different parts of any one of the front surface, the lateral surfaces (the right flank and the left flank), and the back surface of the torso of the person being assisted to thereby reduce a burden on the person being assisted P.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A transfer assistance device comprising:

a bogie;

an arm tiltably supported by the bogie; and a holding part that is supported by the arm and includes at least one of a front surface holding part, a lateral surface holding part, and a back surface holding part, the front surface holding part configured to hold a front surface of a torso of a person being assisted, the lateral surface holding part configured to hold a lateral surface of the torso of the person being assisted, and the back surface holding part configured to hold a back surface of the torso of the person being assisted, wherein the holding part comprises at least a first bag and a second bag configured to respectively face different parts of one of the front surface, the lateral surface, and the back surface of the torso of the person being assisted, wherein the transfer assistance device further comprises an air pressure adjuster configured to individually adjust air pressure of the first bag and air pressure of the second bag, wherein the first bag is configured to face a solar plexus of the front surface of the torso of the person being assisted, wherein the second bag is configured to face some or all parts other than the solar plexus of the front surface of the torso of the person being assisted, wherein the air pressure adjuster is configured to adjust the air pressure of the first bag to be lower than the air pressure of the second bag when the holding part holds the person being assisted, and wherein the second bag is disposed so as to surround the first bag.

2. The transfer assistance device according to claim 1, wherein the first bag includes a first cell group and the second bag includes a second cell group, and the cells of the first cell group have a relatively lower pressure than the cells of the second cell group.

3. The transfer assistance device according to claim 2, wherein the air pressure adjuster includes:

positive pressure supply means for supplying positive pressure to the first cell group and the second cell group, and negative pressure supply means for supplying negative pressure to the first cell group and the second cell group.

4. The transfer assistance device according to claim 3, wherein the positive pressure supply means includes a compressor and a positive pressure tank.

5. The transfer assistance device according to claim 3, wherein the negative pressure supply means includes a vacuum pump and a negative pressure tank.

6. The transfer assistance device according to claim 2, wherein the cells of the first cell group and the cells of the second cell group are not connected.

7. The transfer assistance device according to claim 2, wherein the air pressure adjuster is configured to individually adjust air pressure that is common to the first cell group and air pressure that is common to the second cell glow.

* * * * *